United States Patent [19]

Tobin

[11] Patent Number: 4,478,515

[45] Date of Patent: Oct. 23, 1984

[54] MORTAR MIXER WITH TRIPLE EIGHT MIXING ACTION

[75] Inventor: Robert A. Tobin, Rochester, N.Y.

[73] Assignee: Stone Construction Equipment, Inc., Honeoye, N.Y.

[21] Appl. No.: 536,256

[22] Filed: Sep. 27, 1983

[51] Int. Cl.[3] ..... B28C 5/14; B01F 7/04

[52] U.S. Cl. ..... 366/67; 366/313; 366/325

[58] Field of Search ..... 366/64, 66, 67, 279, 366/309, 312, 313, 325, 327

[56] References Cited

U.S. PATENT DOCUMENTS

| | | | |
|---|---|---|---|
| 103,998 | 6/1870 | Drake | 366/325 |
| 970,419 | 9/1910 | Cargill | 366/64 |
| 2,600,408 | 6/1952 | Komarek | 366/309 |
| 2,750,163 | 6/1956 | Loedige et al. | 366/313 |
| 3,964,732 | 6/1976 | Hartley | 366/279 |

*Primary Examiner*—Philip R. Coe
*Assistant Examiner*—Arthur D. Dahlberg
*Attorney, Agent, or Firm*—Harvey B. Jacobson

[57] ABSTRACT

A mixer for mortar, plaster, fireproofing material and the like utilizing a plurality of mixing paddles supported from a horizontal shaft in a pivotal mixing drum. Six paddles are mounted on the shaft and are oriented in a unique arrangement by which they rotate in a triple eight mixing action constantly dividing and recombining the mixture again and again thereby resulting in a smooth, uniform mix. The paddles are provided with blades arranged so that material in the end of the drum is pushed half way to the middle of the drum by the first blade. The second blade pushes material from the center of the drum halfway toward the end. The next following blade then cuts the resulting pile into two approximately equal parts and pushes one part that has been cut from the pile toward the opposite end of the drum. This action occurs simultaneously at both ends of the drum every time the paddle shaft revolves 360° and up to 50 cycles per minute depending, of course, upon the rotational speed of the paddle shaft. The blades incorporated into the mixer provide an interrupted or staggered spiral which results in dividing, separating and recombining the materials which results in reduced rolling of the mix inasmuch as the interrupted force against the drum end will reduce the tendency of the mix to roll which is caused in a conventional mixer by the horizontal force on the mix being negated by the drum end so that all force will be exerted in a vertical direction.

5 Claims, 9 Drawing Figures

MORTAR MIXER WITH TRIPLE EIGHT MIXING ACTION

BACKGROUND OF THE INVENTION

1. Field of the Invention

The present invention generally relates to mixers and more particularly mixers used in the construction industry to mix mortar, plaster, fireproofing and the like incorporating a pivotally supported horizontally oriented drum having a paddle shaft supported therein and rotatably driven with the paddle shaft including a plurality of paddles thereon to blend the materials with the present invention more specifically relating to the specific construction and function of the paddles on the paddle shaft with each paddle including a unique blade assembly to provide a power blending or mixing action resulting in a triple eight mixing action which constantly divides and recombines the mix again and again thereby resulting in a smooth, uniform mix.

2. Description of the Prior Art

Mixers now used in the construction industry utilize two basic mixing actions. In one arrangement, the material in the mixer drum is pushed from one end of the mixer to the other and back continuously with a series of paddles obtaining a figure eight spiral action. In this arrangement, any given increment of material travels in the same direction and at the same speed as the surrounding increment thus providing minimal mixing action. A second type of mixing action obtained is through extrusion. In this arrangement, some of the material is extruded through the arms on the paddle as it rotates to wait for the next revolution of the paddle to be pushed in the same direction and at the same speed as the material it was extruded from which results in a slow mixing action. Some folding occurs of the material which adds somewhat to the mixing action. Because the blades on the paddles usually make a relatively small angle to the horizontal and/or make a continuous spiral, if the drum is full of mix or if the mix is "stiff", there is a tendency to "roll" the contents with reduced mixing action.

The following U.S. patents relate to the mixing art: U.S. Pat. Nos. 899,071, Sept. 22, 1908; 1,030,250 June 18, 1912; 1,621,099 Mar. 15, 1927; 1,708,947 Apr. 16, 1928; 1,744,294 Jan. 21, 1930; 4,225,247 Sept. 20, 1980.

SUMMARY OF THE INVENTION

An object of the present invention is to provide a mixer for use in the construction industry for mixing mortar, plaster, fireproofing and similar cementitious materials or other materials in which it is desired to thoroughly mix a plurality of materials into a homogeneous mixture with the present invention including a horizontally disposed shaft rotatably supported in a mixer drum that is pivotally supported and provided with open areas in the upper end thereof for receiving materials to be mixed and discharging such materials after mixing with the shaft being driven and provided with a plurality of paddles thereon which are longitudinally and circumferentially spaced along the length of the shaft and provided with uniquely constructed blades which rotate in a triple eight mixing action which constantly divides and recombines the mixture again and again thereby resulting in a smooth uniform mix.

Another object of the invention is to provide a mixer in accordance with the preceding object in which the shaft includes six paddles mounted on the shaft with the outermost paddle and blade at the ends of the drum pushing the material in the end of the drum halfway to the middle drum. The second paddle and blade assembly pushes material from the center of the drum halfway toward one end of the drum and the followikng blade cuts the resulting pile into two ports and pushes one part of it toward the opposite end. The function of the paddle and blade assemblies is occurring simultaneously at both ends of the drum each time the paddles shaft revolves so that when the paddle shaft is driven at 50 rpms, this action occurs simultaneously in both ends of the drum fifty times per minute.

A further object of the invention is to provide a mixer in accordance with the preceding objects in which the usually provided continuous spiral mixing action has been interrupted or staggered thereby resulting in a dividing, separating and recombining mixing action which also reduces the tendency of the mix to roll inasmuch as the interrupted force against the end of the drum will reduce the tendency of the mix to roll.

Still another object of the present invention is to provide a mixer which will produce a more uniform mix, require less maintenance and is capable of quick repair and conversion by substituting blades of different materials onto the paddles.

These together with other objects and advantages which will become subsequently apparent reside in the details of construction and operation as more fully hereinafer described and claimed, reference being had to the accompanying drawings forming a part hereof, wherein like numerals refer to like parts throughout.

DESCRIPTION OF THE PREFERRED EMBODIMENT

Figure 1:
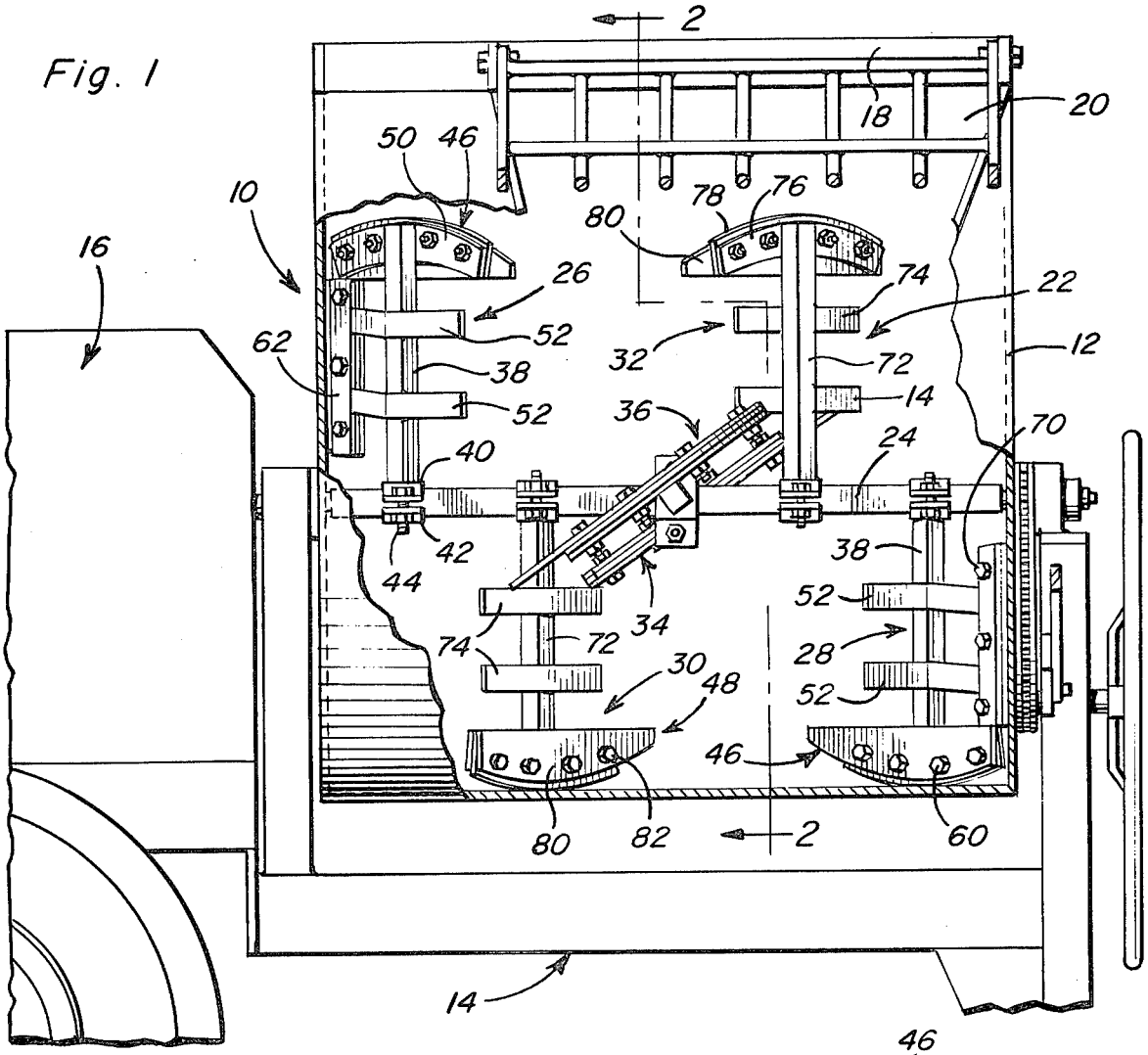
FIG. 1 is a side elevational view of a mixer with portions of the mixer drum broken away to illustrate the structure of the paddles and blades on the paddle shaft.
Figure 3:
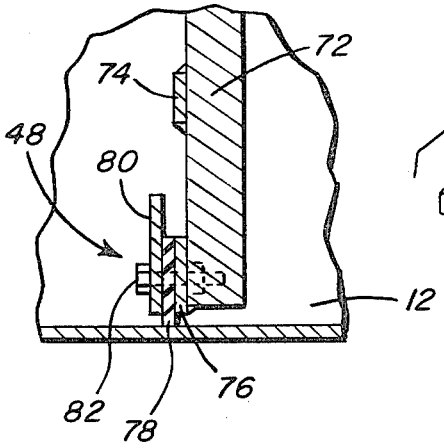
FIG. 3 is a detailed sectional view taken substantially upon a plane passing along section line 3—3 on FIG. 2 illustrating structural details of one of the blades.

The mixer of the present invention is generally designated by numeral 10 and includes the usual mixer drum 12, supporting frame 14 and a power unit 16 all of which represent conventional structural details with the drum 12 including a top opening 18 and a lateral discharge opening 20 at the upper end to enable discharge of materials from the drum when it is manually tilted. Disposed interiorly of the mixer drum 12 is the paddle assembly 22 which forms the essential construction of the present invention. The paddle assembly 22 includes an elongated square paddle shaft 24 which is journalled in the end walls of the drum 12, sealed in relation thereto and driven, all in a conventional manner. Mounted on the paddle shaft 24 is a plurality of paddles which includes a pair of end paddles 26 and 28, a pair of intermediate paddles 30 and 32 and a pair of central paddles 34 and 36 with the paddles 26, 30 and 34 moving material longitudinally in one direction in the drum 12 and the paddles 28, 32 and 36 moving material in the opposite direction in the drum during rotation of the shaft 24.

Each of the paddles 26 and 28 includes a radially extending rigid support rod or arm 38 of square or other suitable configuration having one-half of a clamp 40 on the inner end thereof for matching engagement with a second half of a clamp 42 with the two clamp components 40 and 42 being rigidly but removably secured on the shaft 24 by clamp bolts 44. The interior of the clamp defined by the two clamp halves 40 and 42 is square so that the support rod or arm 38 will be rigidly secured in place on the shaft 24 for rotation therewith. Each of the two end paddles 26 and 28 have a blade assembly 46 of similar construction thereon and each of the intermediate paddles 30 and 32 and center paddles 34 and 36 include a blade assembly 48 which are similar to each other.

Figure 4:
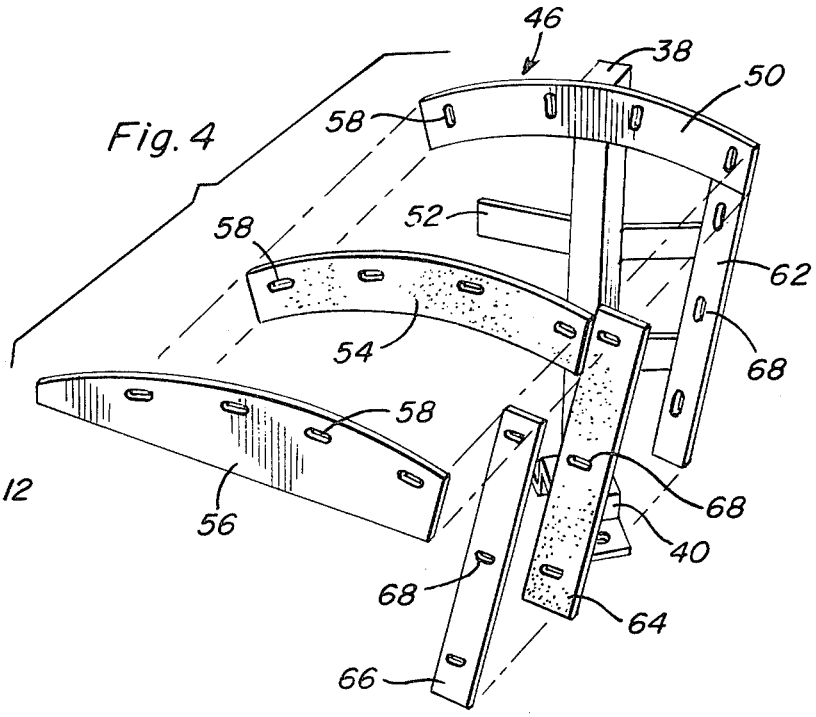
FIG. 4 is an exploded group perspective view illustrating the structural details of one of the end paddles.
Figure 2:
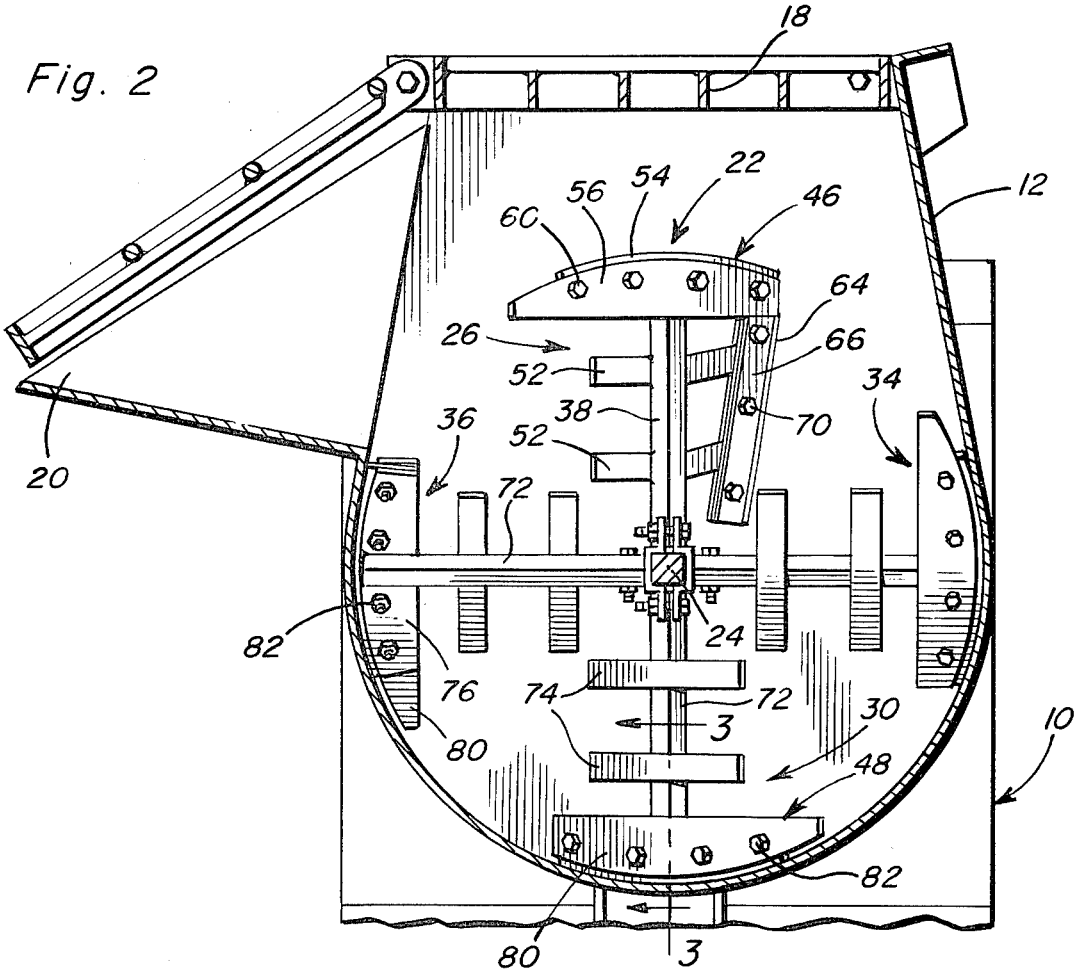
FIG. 2 is a transverse, sectional view taken substantially upon a plane passing along section line 2—2 on FIG. 1 illustrating further structural details of the paddle shaft, paddles and blades thereon.
Figure 5:
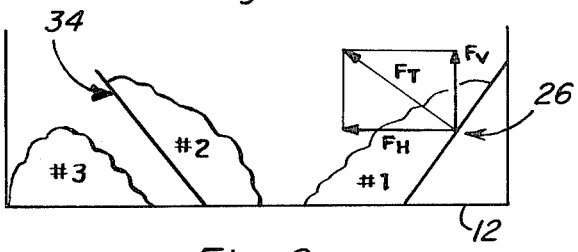
FIGS. 5–9 are schematic illustrations of the manner in which one set of paddles operate to thoroughly mix by dividing, separating and recombining the materials.

FIG. 4 illustrates the details of structure of one of the blade assemblies 46 which includes an arcuate blade member 50 rigidly affixed to the outer end of the radial rod or arm 38. Attached intermediate the length of the rod or arm 38 is a pair of mixing elements 52 which are on the opposite side of the rod or arm 38 from the blade member 50. The blade assembly 46 also includes an arcuate rubber member 54 and an arcuate blade member 56 with the blade member 50, the rubber member 54 and the blade member 56 having apertures 58 therein for receiving fastening bolts 60 which secure the blade members 50 and 56 and the rubber member 54 assembled in a sandwich relation with it being noted that the openings 58 in the blade 50 are radially elongated while the openings 58 in the blade member 56 and rubber member 54 are circumferentially elongated to facilitate insertion of the bolts 60 abd adjustment of the components so that the rubber member 54 may engage the periphery of the drum 12 in a wiping action. The end blade assembly 46 also includes a radially extending blade member 62 rigid with the leading end of the blade member 50 with a corresponding rubber wiping member 64 and blade member 66 providing a sandwiched assembly with each member including apertures 68 for receiving bolts 70 so that the rubber wiping member 64 can engage and wipe the end wall of the drum 12 as illustrated in FIG. 1. As stated, the end blade assemblies 46 are identical to but opposite to each other with one of the end blade assemblies being inclined so that the blade assembly will move the material inwardly towards the center and the other of the blade assemblies 46 also being designed to move the material inwardly toward the center of the drum during unidirectional rotation of the shaft 24.

The blade assemblies 48 are also similar to each other and include a radial supporting rod or arm 72 which is similar to the rod or arm 38 and is mounted from the shaft 24 in the same manner. A pair of mixing elements 74 are mounted on the rod or arm 72 intermediate the ends thereof and at the outer end of the arm 72, a blade member 76 is supported as by welding or the like with a rubber wiping element 78 and a blade member 80 attached thereto and forming a sandwich structure secured removably in place by bolt assemblies 82. In this construction, the mixing elements 74 are on the same side of the radial support arm or rod 72 as the blade member 76.

The central paddles 34 and 36 are supported from a single clamp structure, that is, the two clamp halves each have a radial support arm or rod such as the arm 72 with the paddles 34 and 36 generally paralleling each other in inclined relation to the axis of the shaft 24 and slightly offset from each other due to the fact that one of the paddle assemblies 48 is on one side of the rod or arm 72 and the other blade assembly 48 is on the opposite side which offset arrangement is illustrated in FIG. 1. Thus, the paddles 26, 30 and 34 move material to the right as observed in FIG. 1 whereas the paddles 28, 32 and 36 move material to the left when the shaft 24 is rotated in a clockwise direction as viewed from the right end of FIG. 1.

As illustrated, the blade assemblies 46 and 48 are similar in construction in which the blade element 56 or 80 has a tapered end which extends beyond the trailing end of the blade member 50 and rubber wiping member 54 and the blade member 76 and rubber wiping member 78, respectively, with the inner edge of the blade members 56 and 80 being substantially straight rather than being arcuately curved. This construction enables the components of the blade assemblies to be removed and replaced in the event of wear and also enables the rubber wiping member 54 to be replaced with curved steel blades for plaster and fireproofing mixing without removing the paddles from the shaft.

Figure 8:
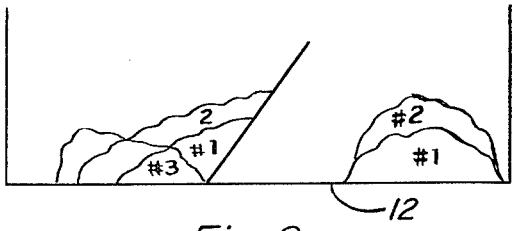
Figure 6:
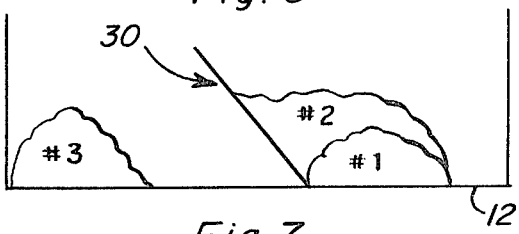
Figure 9:
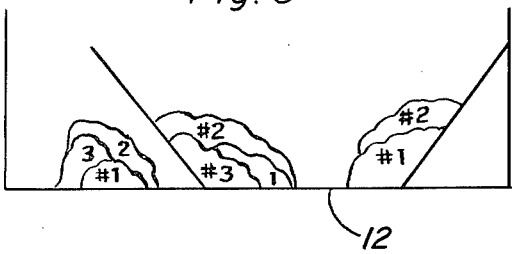
Figure 7:
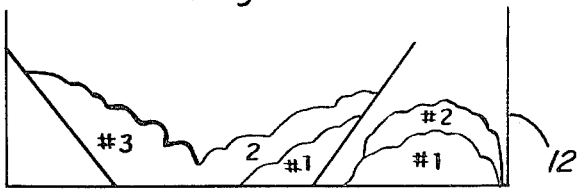

The blades are constructed so that they cut into the mix at approximately 35° from vertical as compared with a conventional angle of approximately 55° which plows the mix. By constructing the blades to cut into the mix at 35°, the component of force in the horizontal direction is therefore increased as illustrated by the vector diagram in FIG. 5 and the component of force in the vertical direction is reduced thereby expending less energy in lifting the mix. In conventional mixer drum structures, the vector of vertical force is greater than the vector of horizontal force whereas in this invention, the vector of horizontal force is greater than the vector of vertical force. This allows larger blades and more paddles to be used without increasing the power required. The sharp angle that the blades enter the mix also reduces the splashing, especially on low slump mixes. Additional mixing action is obtained in the present invention by interrupting or staggering the traditional spiral arrangement which results in a dividing, separating and recombining mixing action in addition to the conventional action. As illustrated in FIGS. 5–9, the first blade pushes the material in the end of the drum halfway to the middle of the drum as indicated by pile No. 1. The second blade pushes material from the center of the drum halfway toward the end as indicated by pile No. 2 and the following blade cuts the resulting pile into two components and pushes part of it toward the opposite end as illustrated in FIGS. 7–9. This action occurs simultaneously at both ends of the drum every time the paddle shaft completes one revolution and up to fifty times per minute, the usual maximum rotational speed of a mixer of this type.

In a conventional mixer drum employing a conventional spiral, when the drum load approaches capacity, the conventional spiral will roll the mix since the horizontal force on the mix will be negated by the drum end and all force will be exerted in the vertical direction. In this invention, because the force against the drum end is interrupted by interrupting the conventional spiral, the tendency to roll the mix is greatly reduced since the horizontal force is greater than the vertical force and will not be negated by the drum end. Also, since the blades overlap, some of the material is extruded when a paddle is pushing material in one direction and this material will be pushed in the opposite direction by the following overlapping blade. While the mixing metal blades overlap, the rubber wiping blades are shorter since duplication or overlapping of the rubber wiping blades would cause extra wear on the drum and require more driving power. As indicated previously, in order to reduce balling and splashing on low slump materials such as fireproofing and plaster material, a special curved metal blade is used which bolts to the same paddles as the straight mortar blade and can be can be used with or without rubber wiper blades.

As indicated in the schematic illustrations in FIGS. 5–9, the use of a sharper angle in combination with the interrupted spiral, enables the mixer to be operated with larger blades, more paddles and higher rpms thereby resulting in an unexpectedly fast, efficient and thorough mixing action.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a mixer having a horizontally disposed mixer drum and a horizontally disposed rotatable shaft mounted in the drum and being rotatably driven, that improvement comprising a plurality of paddles mounted in longitudinally and circumferentially spaced relation on the shaft, each of said paddles including a radially extending support arm rigid with the shaft, a blade assembly at the outer end of each arm and including an outer edge generally conforming with the interior surface of the drum, the endmost blade assemblies including a radially extending blade parallel with and disposed adjacent the inner end surfaces of the drum, each blade assembly including an elongated blade member having an arcuate outer edge generally conforming with the interior surface of the drum and inclined at an angle of approximately 35° relative to a plane perpendicular to the longitudinal axis of said shaft to cut into material in the drum at an angle of approximately 35° in relation to said plane thereby imparting a horizontal vector of force to the material greater than the vertical vector of force imparted to the material to reduce the power required to rotate the shaft by reducing the lifting force exerted on the material, said shaft including six paddles mounted thereon with the two central paddles being substantially aligned with each other on opposite sides of the shaft whereby the mixing action is duplicated in each end portion of the drum with the outermost paddles moving material from the end of the drum halfway to the center of the drum, the second paddle in sequence during rotation moving material from the center of the drum halfway toward the end and the third paddle in the sequence during rotation of the shaft cutting the resulting pile into two parts and pushing one part of the pile toward the opposite end with the above sequence occurring simultaneously at both ends of the drum for each revolution of the paddle shaft.

2. The mixer as defined in claim 1 wherein each blade assembly includes a resilient wiper member and a clamping blade member mounted on said elongated blade member, said clamping blade member and elongated blade member being of metal with the resilient wiper member sandwiched therebetween, said wiper member extending radially beyond the blade members into engagement with the interior surface of the drum.

3. The structure as defined in claim 1 wherein said arms have a pair of spaced mixing elements mounted thereon between the blade assembly and the shaft.

4. The mixer as defined in claim 1 wherein the blades cooperate with each other to provide an interrupted spiral engaging the material thereby dividing, separating and recombining the material during the mixing action.

5. In a mixer having a horizontally disposed mixer drum and a horizontally disposed rotatable shaft mounted in the drum and being rotatably driven, that improvement comprising a plurality of paddles mounted in longitudinally and circumferentially spaced relation on the shaft, each of said paddles including a radially extending support arm rigid with the shaft, a blade assembly at the outer end of each arm, each blade assembly including an elongated blade member having an arcuate outer edge generally conforming with the interior surface of the drum and inclined at an angle of approximately 35° relative to a plane perpendicular to the longitudinal axis of said shaft to cut into material in the drum at an angle of approximately 35° in relation to said plane thereby imparting a horizontal vector of force to the material greater than the vertical vector of force imparted to the material to reduce the power required to rotate the shaft by reducing the lifting force exerted on the material, said shaft including six paddles mounted thereon with the two central paddles being substantially aligned with each other on opposite sides of the shaft whereby the mixing action is duplicated in each end portion of the drum with the outermost paddles moving material from the end of the drum halfway to the center of the drum, the second paddle in sequence during rotation moving material from the center of the drum halfway toward the end and the third paddle in the sequence during rotation of the shaft cutting the resulting pile into two parts and pushing one part of the pile toward the opposite end with the above sequence occurring simultaneously at both ends of the drum for each revolution of the paddle shaft.

* * * * *